US008142009B2

(12) United States Patent
Hishida et al.

(10) Patent No.: US 8,142,009 B2
(45) Date of Patent: Mar. 27, 2012

(54) INKJET PRINTER AND PRINTING METHOD

(75) Inventors: Yuko Hishida, Tomi (JP); Masaru Ohnishi, Tomi (JP); Hironori Hashizume, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 441 days.

(21) Appl. No.: 12/392,935

(22) Filed: Feb. 25, 2009

(65) Prior Publication Data

US 2009/0244157 A1 Oct. 1, 2009

(30) Foreign Application Priority Data

Feb. 29, 2008 (JP) ..... 2008-050374

(51) Int. Cl.
*B41J 2/01* (2006.01)
*B41J 29/38* (2006.01)

(52) U.S. Cl. ..... 347/102; 347/16

(58) Field of Classification Search ..... 347/102, 347/14, 16, 19, 101
See application file for complete search history.

(56) References Cited

U.S. PATENT DOCUMENTS 7,137,696 B2 * 11/2006 Siegel ..... 347/102
7,152,969 B2 * 12/2006 Hintermann ..... 347/102
7,178,913 B2 * 2/2007 Kumamoto et al. ..... 347/102
7,837,319 B2 * 11/2010 Rodin et al. ..... 347/102
2001/0038408 A1 * 11/2001 Codos et al. ..... 347/102
2002/0191063 A1 * 12/2002 Gelbart et al. ..... 347/101
2003/0179270 A1 * 9/2003 Yamamoto et al. ..... 347/102
2003/0227527 A1 * 12/2003 Richards ..... 347/102
2005/0168555 A1 * 8/2005 Niekawa ..... 347/102
2006/0038868 A1 * 2/2006 Otter ..... 347/102
2006/0230969 A1 * 10/2006 Vosahlo ..... 101/488
2006/0238592 A1 * 10/2006 Kadomatsu et al. ..... 347/102
2008/0079795 A1 * 4/2008 Nakazawa ..... 347/102
2008/0174649 A1 * 7/2008 Nakano et al. ..... 347/102
2008/0231679 A1 * 9/2008 Nakhmanovich et al. .... 347/101
2009/0086000 A1 * 4/2009 Yokota ..... 347/102

FOREIGN PATENT DOCUMENTS

JP 2004-188920 7/2004

* cited by examiner

*Primary Examiner* — Stephen Meier
*Assistant Examiner* — Leonard S Liang
(74) *Attorney, Agent, or Firm* — Ditthavong Mori & Steiner, P.C.

(57) ABSTRACT

An inkjet printer including an inkjet head unit having inkjet heads for ejecting UV inks, an UVLED unit having a UVLED for emitting ultraviolet light, and a control unit for controlling the inkjet head unit and the UVLED unit. The control unit controls the inkjet head unit and the UVLED unit to move in the scanning direction, controls the inkjet heads to eject UV inks, and controls the UVLED to emit ultraviolet light of a first light quantity. After that, the control unit controls the inkjet head unit and the UVLED unit to move in the direction opposite to the scanning direction and controls the UVLED to emit ultraviolet light of a second light quantity.

16 Claims, 11 Drawing Sheets

FIG. 8

| CURING STAGE | LIGHT QUANTITY REQUIRED | SCANNING SPEED |
|---|---|---|
| TEMPORARY CURING | 20mJ/cm$^2$ | 2300mm/sec |
| FINAL CURING | 200mJ/cm$^2$ | 220mm/sec |

INKJET PRINTER AND PRINTING METHOD

CROSS-REFERENCE TO RELATED APPLICATION

The present application claims priority under 35 U.S.C. 119 to Japanese Patent Application No. 2008-050374, filed on Feb. 29, 2008, the entire contents of which are herein incorporated by reference.

BACKGROUND OF THE INVENTION

1. Field of the Invention

The present invention relates to an inkjet printer to eject ultraviolet curable ink and a printing method for printing with ultraviolet curable ink.

2. Discussion of the Background

Generally, an inkjet printer of a type ejecting ultraviolet curable ink (UV ink) includes an inkjet head unit having an inkjet head for ejecting UV ink, and an ultraviolet light irradiation unit for emitting ultraviolet light to the UV ink ejected from the inkjet head and deposited on a medium. The UV ink is an ink of a media radical polymerizable type, a cation polymerization reaction type. The UV ink has a property that it is cured by polymerization when irradiated with ultraviolet light.

For curing UV ink, a large-size ultraviolet light irradiation unit is necessary. To solve this problem, JP-A-2004-188920 describes an inkjet printer provided with an ultraviolet light irradiation unit for emitting ultraviolet light to such an extent that UV ink is prevented from blurring. By irradiating the UV ink with ultraviolet light from the ultraviolet light irradiation unit a predetermined number of times, the UV ink is prevented from blurring. This structure attempts a reduction in size of the ultraviolet light irradiation unit. The contents of JP-A-2004-188920 are herein incorporated by reference in their entirety.

However, in the inkjet printer disclosed in JP-A-2004-188920, the ultraviolet light emitted from the ultraviolet light irradiation unit is low intensity and constant so that the ultraviolet light irradiation unit is required to emit ultraviolet light repeatedly. Therefore, there is a problem that it is impossible to effectively cure the UV ink.

Furthermore, there is an idea to provide an ultraviolet light irradiation unit for emitting ultraviolet light of such light intensity as to temporarily cure the UV ink and an ultraviolet light irradiation unit for emitting ultraviolet light of such light intensity as to finally cure the UV ink. Since two ultraviolet light irradiation units are necessary in the inkjet printer, however, there is a problem that the cost is increased.

SUMMARY OF THE INVENTION

An aspect of the present invention is to provide an inkjet printer and a printing method capable of reducing the cost and capable of effectively curing ultraviolet curable ink.

An embodiment of an inkjet printer of the present invention is an inkjet printer of a type ejecting ultraviolet curable ink and includes an ejecting means for ejecting ultraviolet curable ink to a recording medium; an ultraviolet light irradiation means for emitting ultraviolet light to the ultraviolet curable ink ejected from the ejecting means and deposited on the recording medium; and a light quantity changing means for changing the light quantity of the ultraviolet light emitted from the ultraviolet light irradiation means to the ultraviolet curable ink, wherein the light quantity changing means controls the ultraviolet light irradiation means to emit ultraviolet light of a first light quantity for temporarily curing the ultraviolet curable ink and, after that, controls the ultraviolet light irradiation means to emit ultraviolet light of a second light quantity for finally curing the ultraviolet curable ink.

According to an embodiment of the inkjet printer, as ultraviolet curable ink is ejected from the ejecting means, the ultraviolet curable ink is deposited onto the recording medium. As ultraviolet light of the first light quantity is emitted from the ultraviolet light irradiation means, the ultraviolet curable ink deposited on the recording medium is temporarily cured. After that, as ultraviolet light of the second light quantity is emitted from the ultraviolet light irradiation means, the ultraviolet curable ink temporarily cured is finally cured. In this manner, the temporary curing of the ultraviolet curable ink before the final curing can prevent the ultraviolet curable ink from blurring and level the ultraviolet curable ink. As a result, the irregularity of the ultraviolet curable ink is reduced so as to reduce light fringes by the ultraviolet curable ink, thereby improving the printing quality. Further according to the embodiment, by changing the light quantity of ultraviolet light emitted from the ultraviolet light irradiation means, the ultraviolet curable ink can be temporarily cured and also be finally cured. Therefore, the ultraviolet light irradiation means can be shared for temporarily curing the ultraviolet curable ink and finally curing the ultraviolet curable ink, thereby reducing the cost and effectively curing the ultraviolet curable ink.

In this case, it is preferable that the light quantity changing means controls the ultraviolet light irradiation means to emit ultraviolet light of the first light quantity when the ultraviolet light irradiation means moves in a scanning direction and controls the ultraviolet light irradiation means to emit ultraviolet light of the second light quantity when the ultraviolet light irradiation means moves in a direction opposite to the scanning direction.

According to an embodiment of the inkjet printer, as the ultraviolet light irradiation means moves in the scanning direction, the ultraviolet curable ink ejected from the ejecting means are irradiated with ultraviolet light of the first light quantity from the ultraviolet light irradiation means, thereby temporarily curing the ultraviolet curable ink deposited on the medium. After that, as the ultraviolet light irradiation means moves in the direction opposite to the scanning direction, the ultraviolet curable ink temporarily cured is irradiated with ultraviolet light of the second light quantity from the ultraviolet light irradiation means, thereby finally curing the ultraviolet curable ink temporarily cured. As mentioned above, by reciprocating the ultraviolet light irradiation means in the scanning direction, both the temporary curing and the final curing of the ultraviolet curable ink can be achieved, thereby further effectively curing the ultraviolet curable ink.

It is also preferable that the light quantity changing means changes the light quantity of ultraviolet light emitted to the ultraviolet curable ink by changing the light intensity of ultraviolet light emitted from the ultraviolet light irradiation means. According to the embodiment the inkjet printer, since the light quantity is proportional to the light intensity, the light quantity of ultraviolet light emitted from the ultraviolet light irradiation means can be easily changed by changing the light intensity of ultraviolet light emitted from the ultraviolet light irradiation means.

Further, it is preferable that the light quantity changing means changes the light quantity of ultraviolet light emitted to the ultraviolet curable ink by changing the moving speed of the ultraviolet light irradiation means. According to the embodiment of the inkjet printer, the irradiation time of ultraviolet light relative to the ultraviolet curable ink deposited on the recording medium can be changed by changing the moving speed of the ultraviolet light irradiation means. That is, since the light quantity is proportional to the irradiation time, the light quantity of ultraviolet light emitted from the ultraviolet light irradiation means can be easily changed by changing the moving speed of the ultraviolet light irradiation means.

An embodiment of a printing method of the present invention is a printing method for printing with ultraviolet curable ink and includes an ejecting step for ejecting ultraviolet curable ink to a recording medium; a first ultraviolet light irradiation step for setting the light quantity of ultraviolet light emitted from an ultraviolet light irradiation means to a first light quantity for temporarily curing the ultraviolet curable ink and irradiating the ultraviolet curable ink ejected at the ejecting step and deposited on the recording medium with the ultraviolet light; a second ultraviolet irradiation step for setting the light quantity of ultraviolet light emitted from the ultraviolet light irradiation means to a second light quantity for finally curing the ultraviolet curable ink after the first ultraviolet irradiation step and irradiating the ultraviolet curable ink temporarily cured at the first ultraviolet irradiation step with the ultraviolet light.

According to an embodiment of the printing method of the present invention, as ultraviolet curable ink is ejected from the ejecting means, the ultraviolet curable ink is deposited onto the recording medium. As ultraviolet light of the first light quantity is emitted from the ultraviolet light irradiation means, the ultraviolet curable ink deposited on the recording medium is temporarily cured. After that, as ultraviolet light of the second light quantity is emitted from the ultraviolet light irradiation means, the ultraviolet curable ink temporarily cured is finally cured. In this manner, the temporary curing of the ultraviolet curable ink before the final curing can prevent the ultraviolet curable ink from blurring and level the ultraviolet curable ink. As a result, the irregularity of the ultraviolet curable ink is reduced so as to reduce light fringes by the ultraviolet curable ink, thereby improving the printing quality. Further, by changing the light quantity of ultraviolet light emitted from the ultraviolet light irradiation means, the ultraviolet curable ink can be temporarily cured and also be finally cured. Therefore, the ultraviolet light irradiation means can be shared for temporarily curing the ultraviolet curable ink and finally curing the ultraviolet curable ink, thereby reducing the cost and effectively curing the ultraviolet curable ink.

Embodiments of the present invention advantageously achieve a reduction in cost and effective curing of ultraviolet curable ink.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIG. 8 is a diagram showing relationship between the light quantities required for temporary curing and final curing and the scanning speed under conditions employed in FIG. 7;

DETAILED DESCRIPTION OF EXEMPLARY EMBODIMENTS OF THE INVENTION

Figure 1:
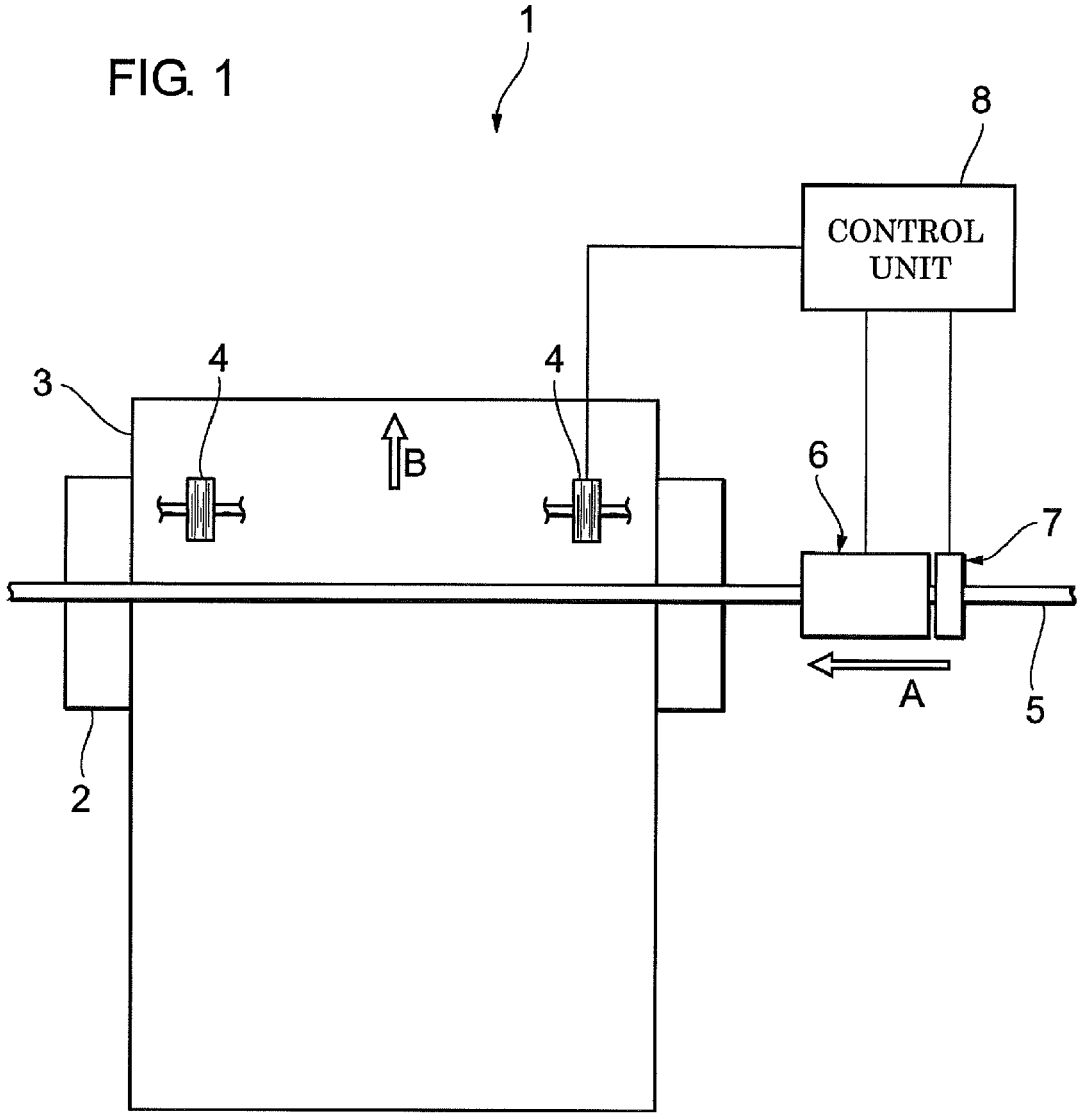
FIG. 1 is a plan view of an inkjet printer according to an embodiment.

Embodiments of the present invention will be described hereinafter with reference to the accompanying drawings. In the following description, the constituent elements having substantially the same function and arrangement are denoted by the same reference numerals, and repetitive descriptions will be made only when necessary. The embodiments of the present invention have the following arrangements.

Figure 2:
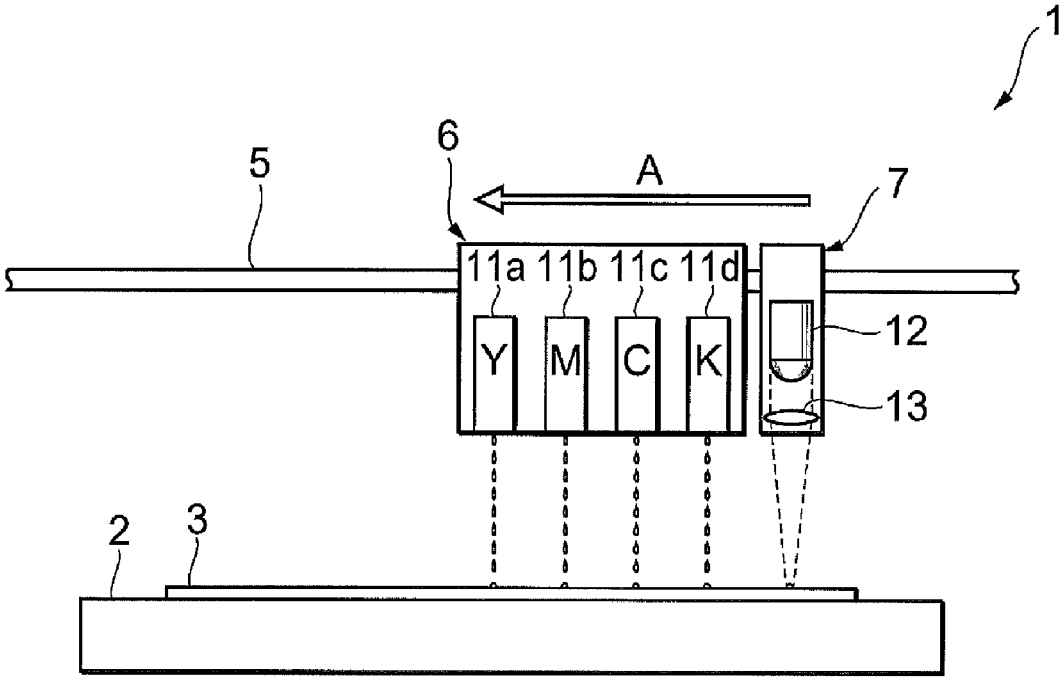
FIG. 2 is a front view of the inkjet printer shown in FIG. 1.

FIG. 1 is a plan view of an inkjet printer according to an embodiment and FIG. 2 is a front view of the inkjet printer. As shown in FIG. 1 and FIG. 2, the inkjet printer 1 of this embodiment is an apparatus for printing images or characters on a medium 3 by ejecting UV ink (ultraviolet curable ink) onto the medium 3 fed on a platen 2.

The inkjet printer 1 is provided with feeding rollers 4 for feeding the medium 3 on the platen 2 in a feeding direction B. In the inkjet printer 1, a guide rail 5 is disposed above the platen 2 (upper side in FIG. 2) to extend in a direction perpendicular to the feeding direction B of the medium 3. On the guide rail 5, an inkjet head unit 6 for ejecting UV ink and a UVLED (Ultraviolet Light Emitting Diode) unit 7 for emitting ultraviolet light are held movably in the extending direction of the guide rail 5.

The inkjet head unit 6 is provided with inkjet heads 11*a*-11*d* for ejecting UV inks of yellow Y, magenta M, cyan C, and black K toward the platen 2. Connected to the inkjet heads 11*a*-11*d* are ink tanks (not shown) for storing UV inks of respective colors, respectively. The UV inks of the respective colors are supplied from the ink tanks to the inkjet heads 11*a*-11*d* so that the UV inks of the respective colors are ejected from the inkjet heads 11*a*-11*d*. That is, a UV ink of yellow Y is ejected from the inkjet head 11*a*, a UV ink of magenta M is ejected from the inkjet head 11*b*, a UV ink of cyan C is ejected from the inkjet head 11*c*, and a UV ink of black K is ejected from the inkjet head 11*d*.

The inkjet heads 11*a*-11*d* are linearly aligned along a scanning direction A and the inkjet head unit 6 is moved by a driving means (not shown) in the scanning direction A (the leftward direction in FIG. 1 and FIG. 2) and a direction opposite to the scanning direction A (the rightward direction in FIG. 1 and FIG. 2). By movement of the inkjet head unit 6 in the scanning direction A, UV inks of four colors are ejected onto a line. The movement of the inkjet head unit 6 is achieved, for example, by rotating a driving belt connected to the inkjet head unit 6 with a motor or the like. A rear end portion (a right end portion in FIG. 1 and FIG. 2) in the scanning direction A of the guide rail 5 is a standby position of the inkjet head unit 6.

The UVLED unit 7 is disposed behind the inkjet head unit 6 in the scanning direction A. The UVLED unit 7 is also moved by a driving means (not shown) in the scanning direction A and the direction opposite to the scanning direction A so that the UVLED unit 7 can be synchronized with the inkjet head unit 6. That is, the UVLED unit 7 moves behind the inkjet head unit 6 in the moving direction when moving in the scanning direction A, while the UVLED unit 7 moves in front of the inkjet head unit 6 in the moving direction when moving in the direction opposite to the scanning direction A. The movement of the UVLED unit 7 is achieved, for example, by rotating a driving belt connected to the UVLED unit 7 with a motor, similarly to the inkjet head unit 6.

The UVLED unit 7 includes a UVLED 12 for emitting ultraviolet light and a condenser lens 13. The condenser lens 13 is a lens for condensing ultraviolet light emitted from the UVLED 12. That is, the condenser lens 13 is disposed so as to condense ultraviolet light emitted from the UVLED 12 onto the UV ink deposited on the medium 3.

The inkjet printer 1 is provided with a control unit 8 for controlling the feeding rollers 4, the inkjet head unit 6, and the UVLED unit 7.

Figure 3:
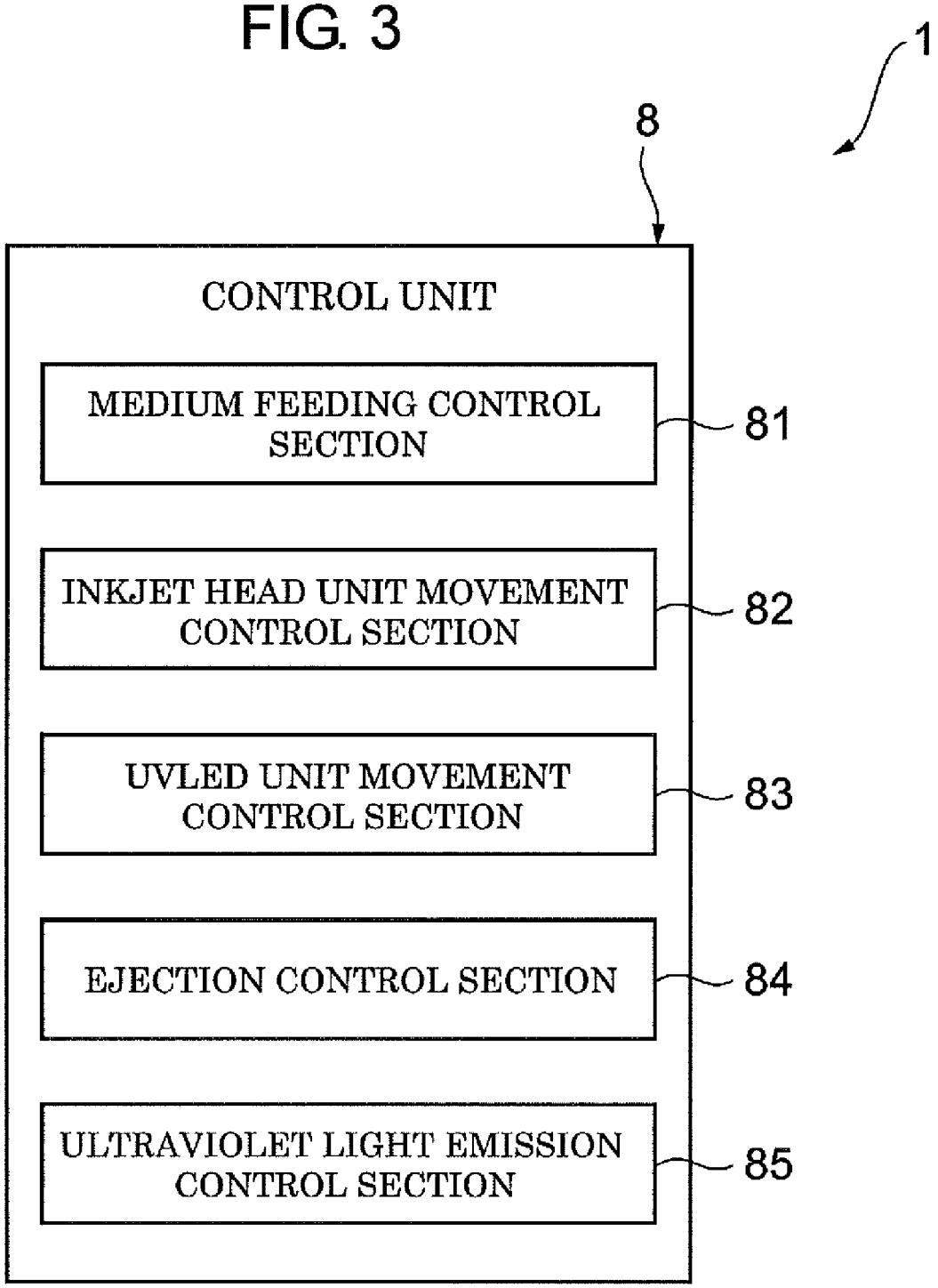
FIG. 3 is a diagram showing an example of functional components of a control unit in the first embodiment.

The control unit 8 controls the feeding rollers 4, the inkjet head unit 6, and the UVLED unit 7 by sending electric signals to the feeding rollers 4, the inkjet head unit 6, and the UVLED unit 7. Therefore, as shown in FIG. 3, the control unit 8 functions as a medium feeding control section 81, an inkjet head unit movement control section 82, a UVLED unit movement control section 83, an ejection control section 84, and an ultraviolet light emission control section 85. The control unit 8 is mainly composed of a computer including a CPU, a ROM, and a RAM.

The medium feeding control section 81 controls the operation of the feeding rollers 4 to feed the medium 3 on the platen 2 in the feeding direction B. The inkjet head unit movement control section 82 controls the operation of the inkjet head unit 6 to move the inkjet head unit 6 in the scanning direction A or the direction opposite to the scanning direction A. The ejection control section 84 controls the ejection of the respective inkjet heads 11*a*-11*d* to make the respective inkjet head 11*a*-11*d* eject the UV inks of the respective colors. The UVLED unit movement control section 83 controls the operation of the UVLED unit 7 to be synchronized with the inkjet head unit 6 to move the UVLED unit 7 in the scanning direction A and the direction opposite to the scanning direction.

Figure 4A:
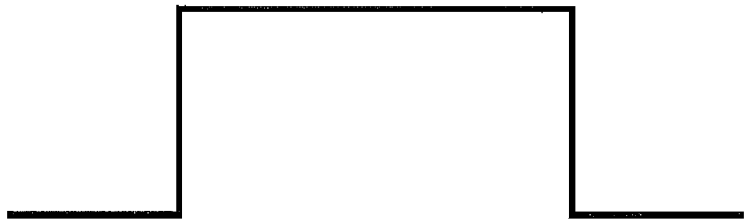
FIGS. 4(*a*) and 4(*b*) are diagrams showing examples of the current flowing in a UVLED, wherein FIG. 4(*a*) shows a direct current and FIG. 4(*b*) shows a pulse current.
Figure 4B:
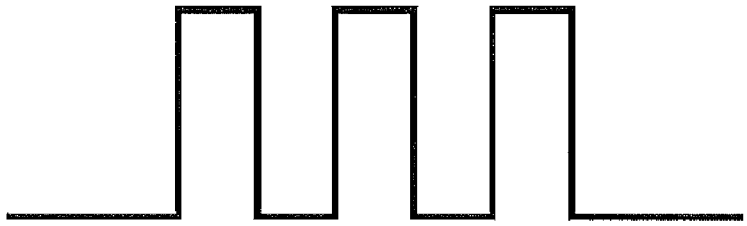

The ultraviolet light emission control section 85 controls the ultraviolet light emission of the UVLED 12 to make the UVLED 12 emit ultraviolet light. The ultraviolet light emission control section 85 adjusts the light quantity of the ultraviolet light emitted from the UVLED 12 to temporarily cure the UV inks and then to finally cure the UV inks. The ultraviolet light emission control section 85 adjusts the light quantity of the ultraviolet light by changing the light intensity of the ultraviolet light emitted from the UVLED 12. The light intensity of the ultraviolet light can be changed by adjusting the current flowing in the UVLED 12. FIGS. 4(*a*) and 4(*b*) are diagrams showing examples of the current flowing in the UVLED, wherein FIG. 4(*a*) shows a case of a direct current and FIG. 4(*b*) shows a case of a pulse current. As shown in FIG. 4(*a*), in case that a direct current flows in the UVLED 12, the light intensity can be changed by changing the current value. As shown in FIG. 4(*b*), in case that a pulse current flows in the UVLED 12, the light intensity can be changed by changing the pulse width or pulse number.

A specific example is described below. The UV ink (monomer) has a property that it is cured by polymerization when irradiated with ultraviolet light. The UV ink before irradiated with ultraviolet light (i.e. the UV ink just after deposited on the medium 3) is low-molecular-weight liquid having low viscosity. As the UV ink is irradiated with ultraviolet light of about 20 mJ/cm$^2$ in quantity, the molecular weight of the UV ink is increased and the viscosity is thus increased so that the UV ink pectizes. This state is the temporarily cured state. The temporarily cured state means, for example, a state that nature of solid is stronger than nature of liquid. As the UV ink in this state is irradiated with ultraviolet light of about 200 mJ/cm$^2$ in quantity, the molecular weight of the UV ink is further increased. This state is the finally cured state.

As the UV ink is finally cured, the figuration of the UV ink when finally cured is maintained. In the temporarily cured state of the UV ink, however, the figuration of the UV ink can vary, but the variation rate is slow. Accordingly, in the temporarily cured state of the UV ink, the spread of the UV ink is decelerated and the thickness of the UV ink is reduced. That is, the blurring of the UV ink can be prevented and the irregularity by the UV ink is reduced to achieve leveling.

Figure 5:
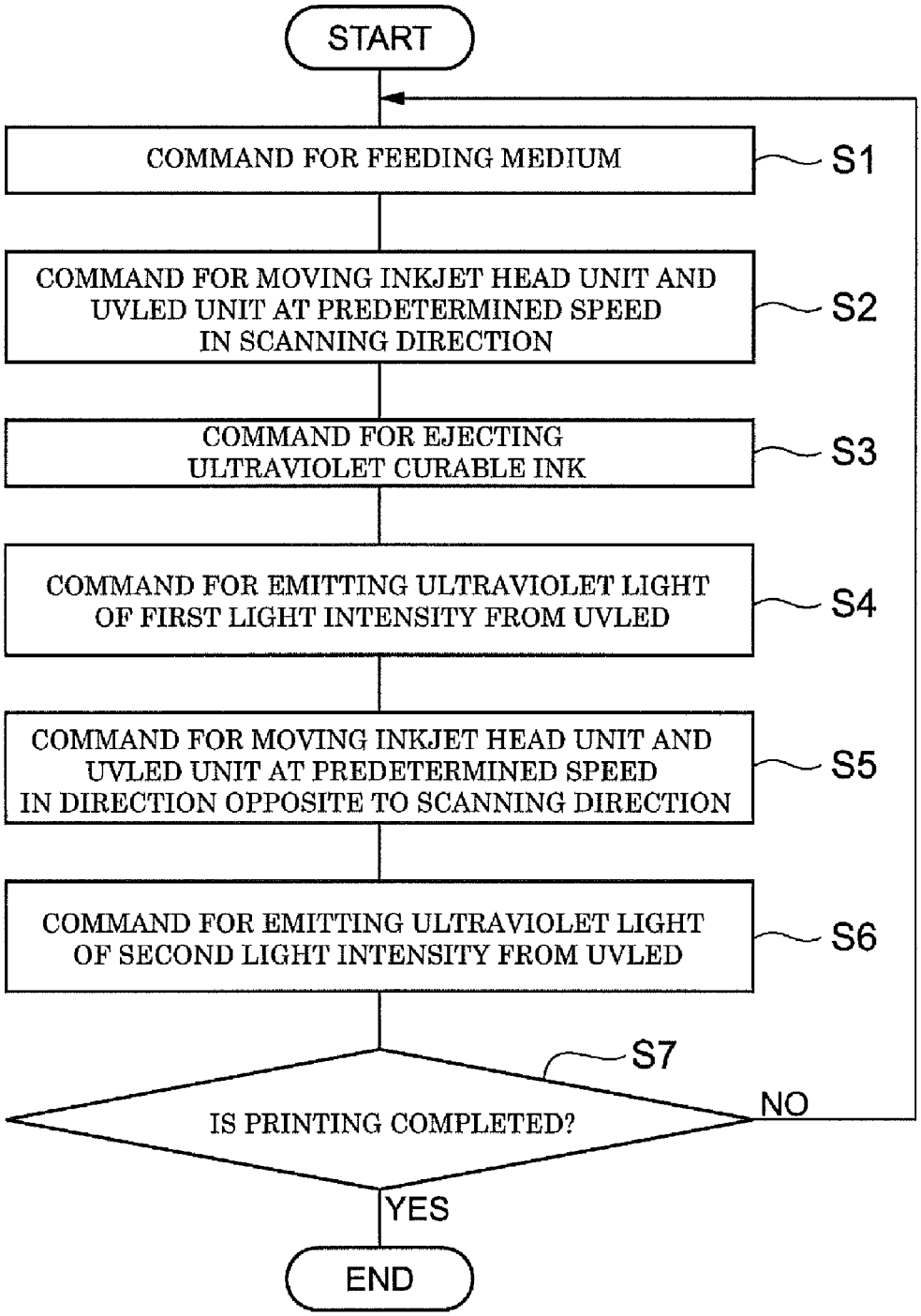
FIG. 5 is a flowchart showing the actions of the control unit in the first embodiment.

Now, the actions of the inkjet printer 1 according to this embodiment will be described with reference to FIG. 5. FIG. 5 is a flowchart showing the actions of the inkjet printer. The actions of the inkjet printer 1 as will be described below are conducted by the control of the control unit 8. That is, in the control unit 8, a processing section (not shown) composed of a CPU integrally manages respective functions of the medium feeding control section 81, the inkjet head unit movement control section 82, the UVLED unit movement control section 83, the ejection control section 84, and the ultraviolet light emission control section 85, thereby performing the following processes.

As the printing is started, the control unit 8 outputs a command signal for controlling the operation of the feeding rollers 4 to feed the medium 3 on the platen 2 in the feeding direction B (step S1). Then, the feeding rollers 4 feed the medium 3 to set the medium 3 at a print start position (print start position in case of moving per pass).

Then, the control unit 8 outputs a command signal for commanding the inkjet head unit 6 and the UVLED unit 7 to move in the scanning direction A at a predetermined speed (step S2). That is, in the step S2, the control unit 8 outputs a command signal for controlling the operation of the inkjet head unit 6 and the UVLED unit 7 to move in synchronism with each other. Thus, the inkjet head unit 6 and the UVLED unit 7 move in the scanning direction A at the predetermined speed in synchronism with each other.

The control unit 8 outputs a command signal for commanding the respective inkjet heads 11*a*-11*d* to eject the UV inks of respective colors (step S3). That is, in the step S3, the control unit 8 outputs a command signal for controlling the ejection of the inkjet heads 11*a*-11*d* to eject the UV inks, respectively, when the inkjet head unit 6 reaches positions where each UV ink is required to be ejected. Thus, the inkjet heads 11*a*-11*d* eject the UV inks of the respective colors at the positions where each UV ink is required to be ejected. The positions of the inkjet heads 11*a*-11*d* are exactly detected by an encoder. As the detection data of the encoder indicate a print position in the scanning direction A, the control unit 8 outputs a command signal for UV ink ejection in the wake of reception of the detection data.

The control unit 8 outputs a command signal for commanding the UVLED 12 to emit ultraviolet light of a first light intensity (step S4). That is, in step S4, the control unit 8 outputs a command signal for setting the light intensity of ultraviolet light to be emitted from the UVLED 12 to the first light intensity and controlling the UVLED 12 to emit the ultraviolet light. Thus, the UVLED 12 emits the ultraviolet light of the first light intensity. Since the light quantity can be expressed by "light quantity=light intensity×irradiation time," the light quantity is obtained by multiplication of the light intensity with the irradiation time. Therefore, the first light intensity is set in such a manner that the accumulated light quantity (a first light quantity) of ultraviolet light emitted onto the UV ink is 20 mJ/cm$^2$ when the UVLED unit 7 moves at the predetermined speed.

The UVLED 12 takes a predetermined offset time to reach a required output level (the first light intensity) after being turned on (starting emission of ultraviolet light). Accordingly, the command of the control unit 8 is preferably conducted, taking the offset time of the UVLED 12 into consideration, such that the ultraviolet light is emitted only on a printable range of the medium 3.

As the UV ink (monomer) is irradiated with the ultraviolet light of which the accumulated light quantity is 20 mJ/cm$^2$ in the step S4, the UV ink has increased viscosity because the molecular weight is increased so that the UV ink is temporarily cured. That is, as the UV ink is temporarily cured, the figuration of the UV ink may vary, but the variation rate is slow. Therefore, the spread of the UV ink is decelerated and the leveling is gradually conducted until the UV ink is finally cured.

Then, the control unit 8 outputs a command signal for commanding the inkjet head unit 6 and the UVLED unit 7 to move in the direction opposite to the scanning direction A at the predetermined speed to return to their standby positions (step S5). That is, in the step S5, the control unit 8 outputs a command signal for controlling the operation of the inkjet head unit 6 and the UVLED unit 7 to move in the direction opposite to the scanning direction A until the inkjet head unit 6 and the UVLED unit 7 return to their standby positions. Thus, the inkjet head unit 6 and the UVLED unit 7 move in the direction opposite to the scanning direction A to return to their standby positions.

The control unit 8 outputs a command signal for commanding the UVLED 12 to emit ultraviolet light of a second light intensity (step S6). That is, in step S6, the control unit 8 outputs a command signal for setting the light intensity of ultraviolet light to be emitted from the UVLED 12 to the second light intensity and controlling the UVLED 12 to emit the ultraviolet light. Thus, the UVLED 12 emits the ultraviolet light of the second light intensity. Therefore, the second light intensity is set in such a manner that the accumulated light quantity (a second light quantity) of ultraviolet light emitted onto the UV ink is 200 mJ/cm$^2$ when the UVLED unit 7 moves at the predetermined speed.

As the UV ink is irradiated with the ultraviolet light of which the accumulated light quantity is 200 mJ/cm$^2$ in the step S6, the UV ink which was temporarily cured in the step S4 has further increased molecular weight so that the UV ink is finally cured.

Then, the control unit 8 determines whether or not printing is completed (step S7). When, in the step S7, it is determined that the printing is not completed (No in the step S7), the control unit 8 returns to the step S1 and repeats the aforementioned processes. On the other hand, when, in the step S7, it is determined that the printing is completed (Yes in the step S7), the control unit 8 terminates the printing process.

According to the inkjet printer 1 of the first embodiment, UV inks are ejected from the inkjet head unit 6 (the inkjet heads 11*a*-11*d*) so that the UV inks are deposited on the medium 3. As the UV inks deposited on the medium 3 are irradiated with ultraviolet light of the first light quantity from the UVLED unit 7 (the UVLED 12), the UV inks (monomer) deposited on the medium 3 are temporarily cured. After that, the UV inks temporarily cured are irradiated with ultraviolet light of the second light quantity from the UVLED 12, the UV inks are finally cured. In this manner, the temporary curing of the UV inks before the final curing can prevent the UV inks from blurring and level the UV inks. As a result, the irregularity of the UV inks are reduced so as to reduce light fringes by the UV inks, thereby improving the printing quality. Further, since the UV inks are leveled and the thickness of the UV inks is reduced, it is preferable when printing is conducted by superposing the UV inks because the angle at an end of a UV ink superposed on the previous one can be small. Therefore, the UV ink superposed can be prevented from exfoliating due to retraction by the UV ink on the medium 3 side (the lower side).

According to this embodiment, by changing the light quantity of ultraviolet light emitted from the UVLED 12, the UV inks can be temporarily cured and also be finally cured. Therefore, the UVLED 12 can be shared for temporarily curing the UV inks and finally curing the UV inks, thereby reducing the cost and effectively curing the UV inks.

According to the inkjet printer 1, the UVLED unit 7 is arranged behind the inkjet head unit 6 in the scanning direction A. Therefore, as the UVLED unit 7 moves in the scanning direction, the UV inks ejected from the inkjet heads 11*a*-11*d* are irradiated with ultraviolet light of the first light quantity from the UVLED 12, thereby temporarily curing the UV inks deposited on the medium 3. After that, as the UVLED unit 7 moves in the direction opposite to the scanning direction A, the UV inks temporarily cured are irradiated with ultraviolet light of the second light quantity from the UVLED 12, thereby finally curing the UV inks temporarily cured. As mentioned above, by reciprocating the UVLED 12 in the scanning direction A, both the temporary curing and the final curing of the UV inks can be achieved, thereby further effectively curing the UV inks.

According to the inkjet printer 1, the light quantity of ultraviolet light emitted from the UVLED 12 can be easily changed by changing the light intensity of ultraviolet light emitted from the UVLED 12. That is, since the UVLED unit 7 moves at the predetermined speed, the UV inks are temporarily cured by making the UVLED 12 emit ultraviolet light of the first light intensity, while the UV inks are finally cured by making the UVLED 12 emit ultraviolet light of the second light intensity.

Hereinafter, a second embodiment will be described. An inkjet printer 21 according to the second embodiment is basically the same as the inkjet printer 1 according to the first embodiment, except the function of the control unit 8. Therefore, description will be made with regard to only a portion different from the inkjet printer 1 according to the first embodiment.

Figure 6:
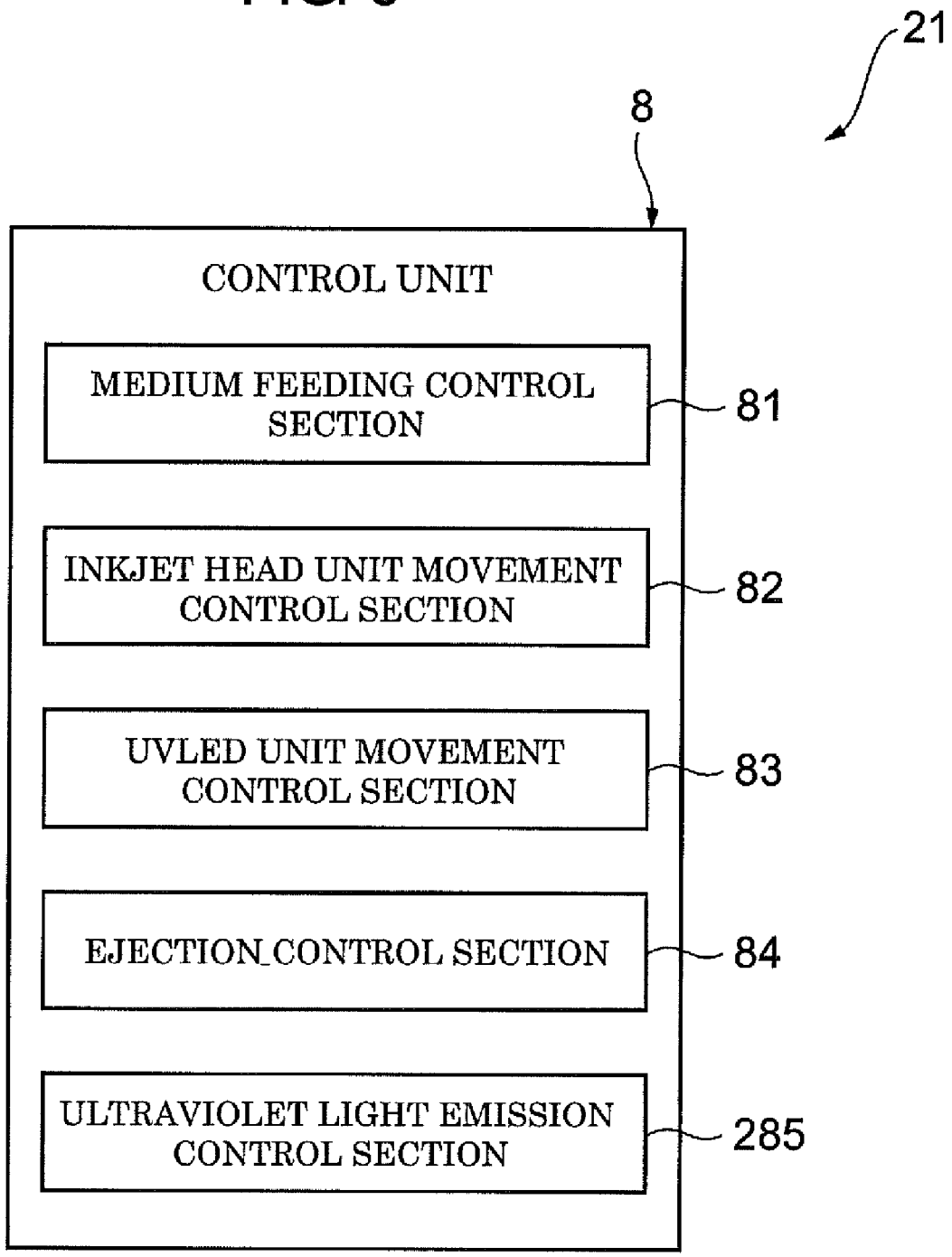
FIG. 6 is a diagram showing an example of functional components of the control unit in a second embodiment.

As shown in FIG. 6, the control unit 8 of the inkjet printer 21 functions as a medium feeding control section 81, an inkjet head unit movement control section 82, a UVLED unit movement control section 83, an ejection control section 84, and an ultraviolet light emission control section 285.

The ultraviolet light emission control section 285 controls the ultraviolet light emission of the UVLED 12 to make the UVLED 12 emit ultraviolet light. The ultraviolet light emission control section 285 temporarily cures UV inks by adjusting the light quantity of ultraviolet light emitted from the UVLED 12 and, after that, finally cures the UV inks which were temporarily cured. The ultraviolet light emission control section 285 adjusts the light quantity of ultraviolet light by changing the moving speed of the UVLED unit 7.

Figure 7:
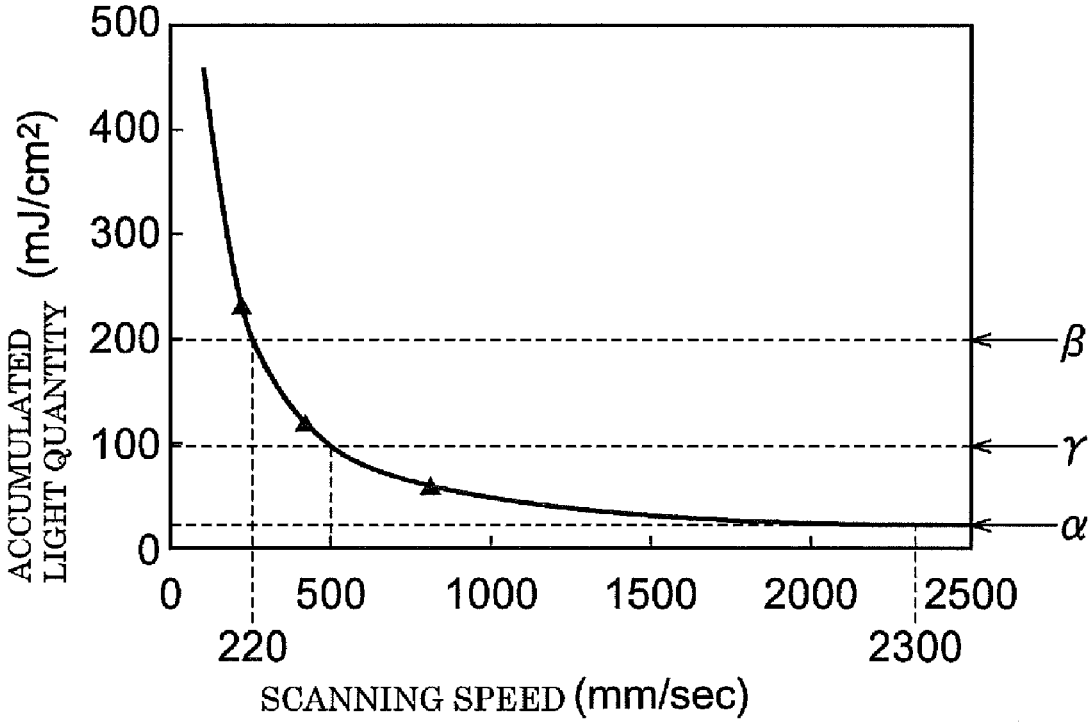
FIG. 7 is a graph showing relationship between the scanning speed and the accumulated light quantity.

FIG. 7 is a graph showing relationship between the scanning speed and the accumulated light quantity and FIG. 8 is a diagram showing relationship between the light quantities required for temporary curing and final curing and the scanning speed under conditions employed in FIG. 7.

The graph of FIG. 7 shows relationship between the scanning speed and the accumulated light quantity when the UVLED 12 passes the UV ink once under the conditions that the distance (gap) from the UVLED 12 to the medium 3 is 15 mm and the output of the UVLED 12 is 24 A. As shown in FIG. 7, when the output (light intensity) of the UVLED 12 is constant, the accumulated light quantity is reduced as the scanning (moving) speed of the UVLED 12 is increased, while the accumulated light quantity is increased as the scanning (moving) speed of the UVLED 12 is decreased. As shown in FIG. 8, as the UVLED unit 7 is moved at 2300 mm/sec under the conditions employed in FIG. 7, the UV inks deposited on the medium 3 are irradiated with ultraviolet light of which accumulated light quantity is 20 mJ/cm$^2$ (see $\alpha$ in FIG. 7), thereby temporarily curing the UV inks. On the other hand, as the UVLED unit 7 is moved at 220 mm/sec under the conditions employed in FIG. 7, the UV inks deposited on the medium 3 are irradiated with ultraviolet light of which accumulated light quantity is 200 mJ/cm$^2$ (see $\beta$ in FIG. 7), thereby finally curing the UV inks.

In the following description, it is assumed that the moving speed of the UVLED unit 7 in case that the UV inks are irradiated with ultraviolet light of which accumulated light quantity is 20 mJ/cm$^2$ when the UVLED 12 emits ultraviolet light of the predetermined light intensity is a first speed, while the moving speed of the UVLED unit 7 in case that the UV inks are irradiated with ultraviolet light of which accumulated light quantity is 200 mJ/cm$^2$ when the UVLED 12 emits ultraviolet light of the predetermined light intensity is a second speed.

Figure 9:
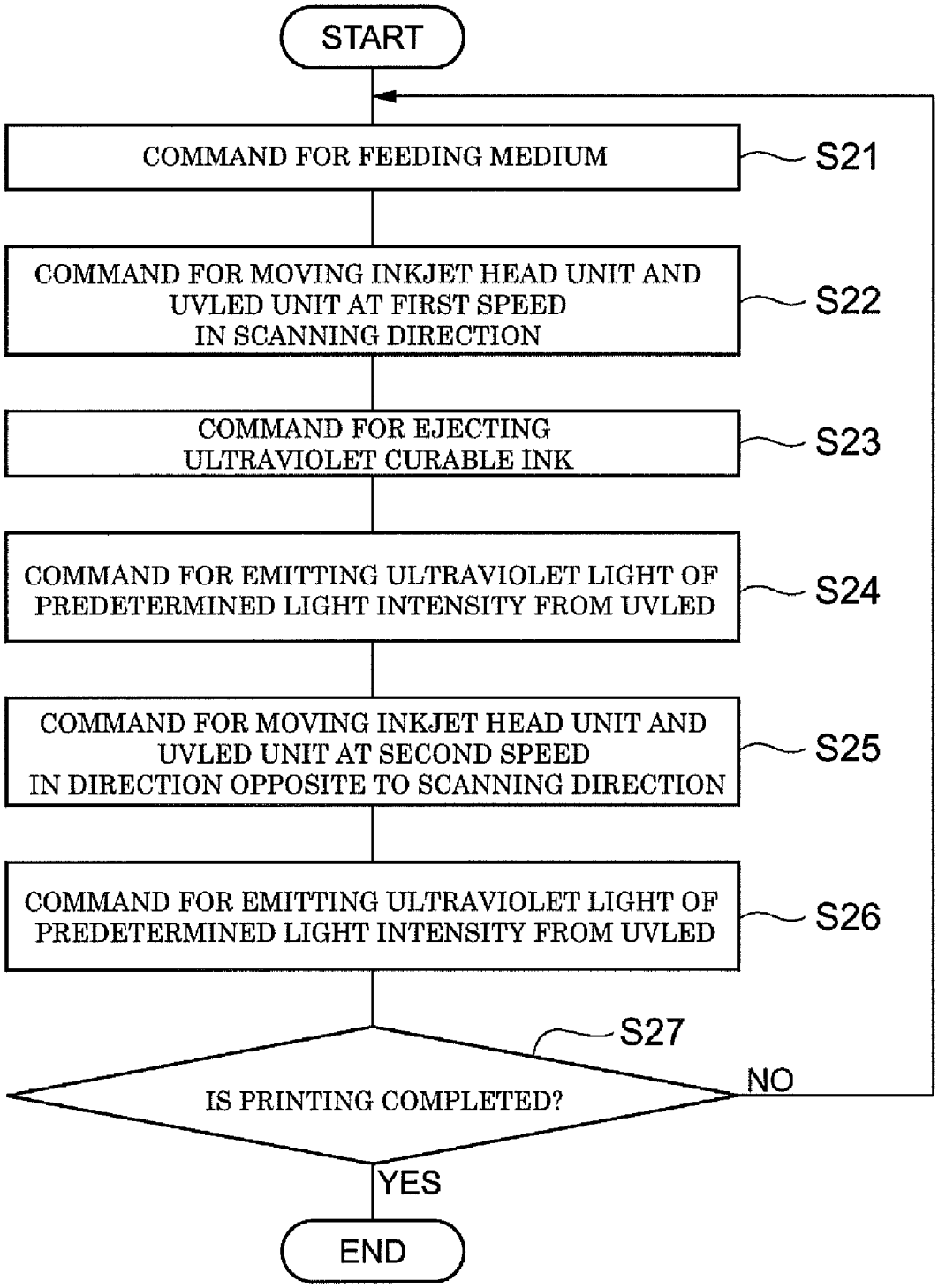
FIG. 9 is a flowchart showing the actions of the control unit in the second embodiment.

Now, the actions of the inkjet printer 21 according to this embodiment will be described with reference to FIG. 9. FIG. 9 is a flowchart showing the actions of the inkjet printer. The actions of the inkjet printer 21 as will be described below are conducted by the control of the control unit 8.

As the printing is started, the control unit 8 controls the operation of the feeding rollers 4 to feed the medium 3 on the platen 2 in the feeding direction B (step S21).

Then, the control unit 8 outputs a command signal for commanding the inkjet head unit 6 and the UVLED unit 7 to move in the scanning direction A at the first speed (step S22). That is, in the step S22, the control unit 8 outputs a command signal for controlling the operation of the inkjet head unit 6 and the UVLED unit 7 to move at the first speed in synchronism with each other. Thus, the inkjet head unit 6 and the UVLED unit 7 move in the scanning direction A at the first speed in synchronism with each other.

The control unit 8 outputs a command signal for commanding the respective inkjet heads 11*a*-11*d* to eject the UV inks of respective colors (step S23). That is, in the step S23, the control unit 8 outputs a command signal for controlling the ejection of the inkjet heads 11*a*-11*d* to eject the UV inks, respectively, when the inkjet head unit 6 reaches positions where each UV ink is required to be ejected. Thus, the inkjet heads 11*a*-11*d* eject the UV inks of the respective colors at the positions where each UV ink is required to be ejected.

The control unit 8 outputs a command signal for commanding the UVLED 12 to emit ultraviolet light of a predetermined light intensity (step S24). Thus, the UVLED 12 emits the ultraviolet light of the predetermined light intensity. The predetermined light intensity is such a light intensity that the accumulated light quantity of ultraviolet light emitted onto the UV ink is 20 mJ/cm$^2$ when the UVLED unit 7 moves at the first speed.

As the UV ink (monomer) is irradiated with the ultraviolet light of which the accumulated light quantity is 20 mJ/cm$^2$ in the step S24, the UV ink has increased viscosity because the molecular weight is increased so that the UV ink is temporarily cured. That is, as the UV ink is temporarily cured, the figuration of the UV ink may vary, but the variation rate is slow. Therefore, the spread of the UV ink is decelerated and the leveling is gradually conducted until the UV ink is finally cured.

Then, the control unit 8 outputs a command signal for commanding the inkjet head unit 6 and the UVLED unit 7 to move in the direction opposite to the scanning direction A at the second speed to return to their standby positions (step S25). That is, in the step S25, the control unit 8 outputs a command signal for controlling the operation of the inkjet head unit 6 and the UVLED unit 7 to move at the second speed in the direction opposite to the scanning direction A until the inkjet head unit 6 and the UVLED unit 7 return to their standby positions. Thus, the inkjet head unit 6 and the UVLED unit 7 move at the second speed in the direction opposite to the scanning direction A to return to their standby positions.

The control unit 8 outputs a command signal for commanding the UVLED 12 to emit ultraviolet light of the predetermined light intensity (step S26). Thus, the UVLED 12 emits the ultraviolet light of the predetermined light intensity. It should be noted that the light intensity of the ultraviolet light emitted from the UVLED 12 in the step S26 is equal to the light intensity of the ultraviolet light emitted from the UVLED 12 in the step S24. Since the UVLED unit 7 moves at the second speed, however, the accumulated light quantity of ultraviolet light emitted onto the UV ink is 200 mJ/cm$^2$.

As the UV ink is irradiated with the ultraviolet light of which the accumulated light quantity is 200 mJ/cm$^2$ in the step S26, the UV ink which was temporarily cured in the step S24 has further increased molecular weight so that the UV ink is finally cured.

Then, the control unit 8 determines whether or not printing is completed (step S27). When, in the step S27, it is determined that the printing is not completed (No in the step S27), the control unit 8 returns to the step S21 and repeats the aforementioned processes. On the other hand, when, in the step S27, it is determined that the printing is completed (Yes in the step S27), the control unit 8 terminates the printing process.

According to the inkjet printer 21 of the second embodiment, the light quantity of ultraviolet light emitted from the UVLED 12 can be easily changed by changing the moving speed of the UVLED unit 7 and thus changing the irradiation time of the ultraviolet light relative to the UV ink deposited on the medium 3. That is, the UV ink is temporarily cured by moving the UVLED unit 7 at the first speed while the UVLED 12 emits ultraviolet light of the constant intensity. The UV ink is finally cured by moving the UVLED unit 7 at the second speed while the UVLED 12 emits ultraviolet light of the constant intensity.

Though the preferred embodiments of the present invention have been described, the present invention is not limited to the aforementioned embodiments. For example, though the inkjet head unit 6 and the UVLED unit 7 move in synchronism with each other in the aforementioned embodiments, these may move in asynchronism with each other.

The inkjet head unit 6 and the UVLED unit 7 are separately formed as discrete parts and are thus separately controlled in the aforementioned embodiments, any relationship between the inkjet head unit 6 and the UVLED unit 7 may be taken. For example, the inkjet head unit 6 and the UVLED unit 7 may be connected or integrally formed. In this case, the inkjet head unit 6 and the UVLED unit 7 can be driven by a single driving means to move together with each other.

Figure 10:
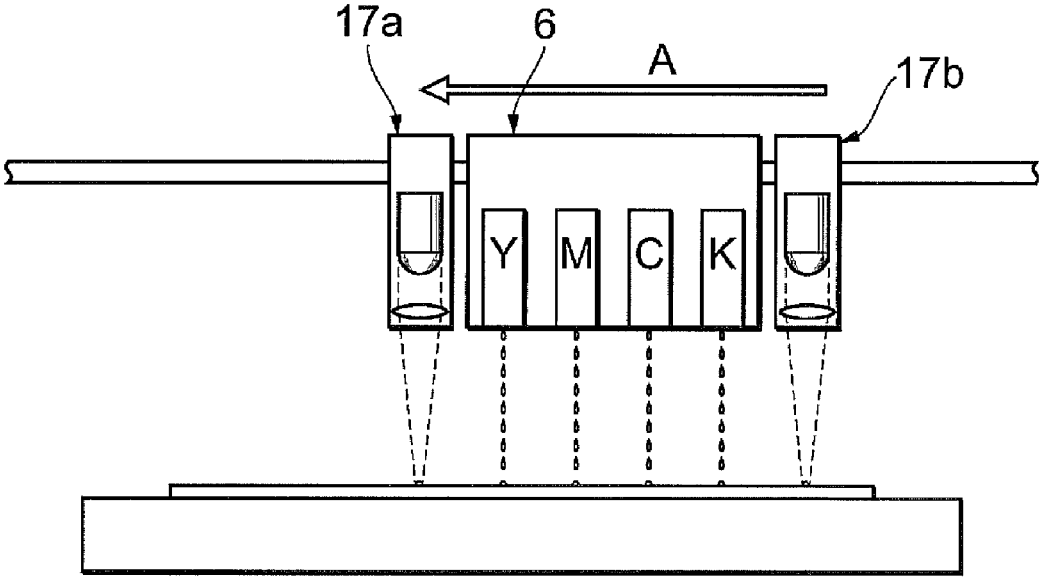
FIG. 10 is an illustration showing a positional relationship between inkjet head units and UVLED units.
Figure 11:
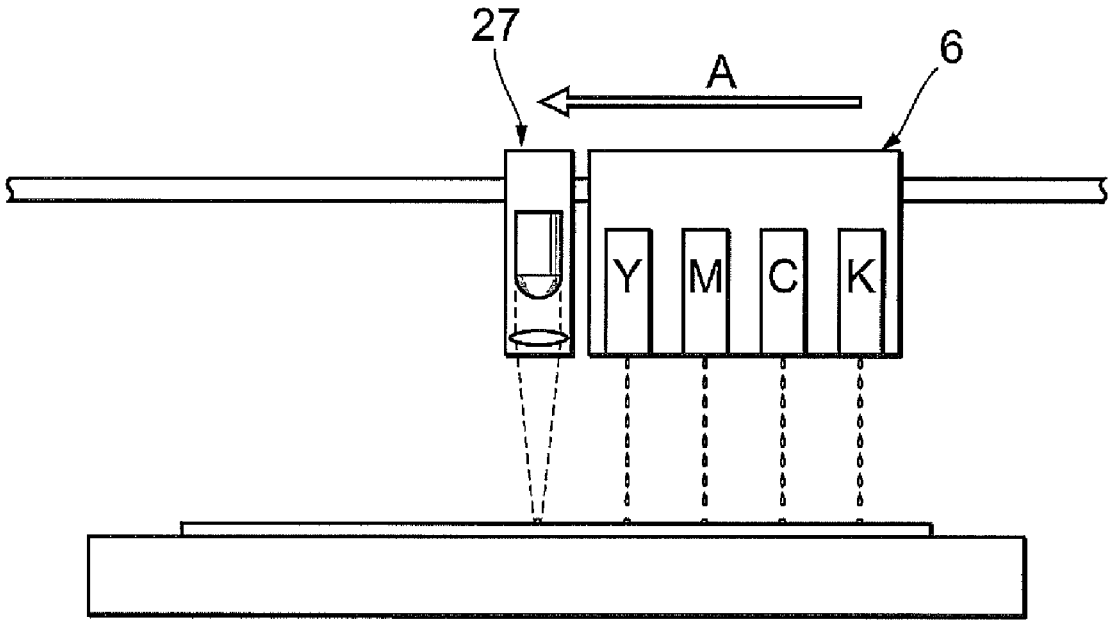
FIG. 11 is an illustration showing a positional relationship between an inkjet head unit and a UVLED unit.

Though the UVLED unit 7 is arranged behind the inkjet head unit 6 in the scanning direction A in the aforementioned embodiments, any positional relationship between the inkjet head unit 6 and the UVLED unit 7 may be taken. For example, as shown in FIG. 10, a UVLED unit 17*a* may be arranged in front of the inkjet head unit 6 in the scanning direction A and a UVLED unit 17*b* may be arranged behind the inkjet head unit 6 in the scanning direction A. Further, as shown in FIG. 11, a UVLED unit 27 may be arranged in front of the inkjet head unit 6 in the scanning direction A.

In case of the positional relationship shown in FIG. 10, when the inkjet head unit 6, the UVLED unit 17*a*, and the UVLED unit 17*b* move in the scanning direction A, the UVLED unit 17*a* does not emit ultraviolet light and the UVLED unit 17*b* emits ultraviolet light of which light quantity is 20 mJ/cm$^2$, thereby temporarily curing the UV ink. On the other hand, when the inkjet head unit 6, the UVLED unit 17*a*, and the UVLED unit 17*b* move in the direction opposite to the scanning direction A, each of the UVLED unit 17*a* and the UVLED unit 17*b* emits ultraviolet light of which light quantity is 100 mJ/cm$^2$, thereby finally curing the UV ink which was temporarily cured. In this case, when a method of the second embodiment is employed, that is, the accumulated light quantity emitted onto the UV ink is changed by changing the moving speed of the UVLED unit 7, the UVLED unit 17*a* and the UVLED unit 17*b* are moved at 500 mm/sec as shown in FIG. 7, total 200 mJ/cm$^2$ as the accumulated light quantity is obtained from the UVLED unit 17*a* and the UVLED unit 17*b* (see γ in FIG. 7).

Though the UV ink is temporarily cured when being irradiated with ultraviolet light of which light quantity is 20 mJ/cm$^2$ and the UV ink is finally cured when being irradiated with ultraviolet light of which light quantity is 200 mJ/cm$^2$ in the aforementioned embodiments, the light quantities of ultraviolet light required for the temporary curing and the final curing depend on various factors such as components of UV ink and are thus set suitably.

Though the UVLED is employed as the ultraviolet light irradiation means in the aforementioned embodiments, any device capable of emitting ultraviolet light such as UV lamp may be employed. Further, the number of UVLEDs arranged in the UVLED unit may be one or plural.

Though the inkjet printer 1, 21 is provided with the feeding rollers 4 for feeding the medium 3 in the aforementioned embodiments, another mechanism not the feeding rollers 4 may be employed to feed the medium 3.

Though the inkjet head unit 6 with the UVLED unit 7 and the medium 3 are moved relative to each other by feeding the medium 3 in the feeding direction B in the aforementioned embodiment, the inkjet head unit 6 with the UVLED unit 7 may be moved instead of the medium 3 or both of the inkjet head unit 6 with the UVLED unit 7 and the medium 3 may be moved. For example, the present invention may be applied to a flat-bed-type inkjet printer which includes a flat bed on which a medium 3 is put and fixed and a mechanism for moving the inkjet head unit 6 and the UVLED unit 7 in the feeding direction B and a direction opposite to the feeding direction B. Even with the flat-bed-type inkjet printer, the inkjet head unit 6 with the UVLED unit 7 and the medium 3 can be moved relative to each other in the feeding direction B, thereby obtaining the same works and effects of the aforementioned inkjet printers 1, 21 in which the medium 3 is fed in the feeding direction B.

It should be noted that the exemplary embodiments depicted and described herein set forth the preferred embodiments of the present invention, and are not meant to limit the scope of the claims hereto in any way. Numerous modifications and variations of the present invention are possible in light of the above teachings. It is therefore to be understood that, within the scope of the appended claims, the invention may be practiced otherwise than as specifically described herein.

What is claimed is:

1. An inkjet printer to eject ultraviolet curable ink, said inkjet printer comprising:

ejecting means for ejecting ultraviolet curable ink to a recording medium;

ultraviolet light irradiation means for emitting ultraviolet light to the ultraviolet curable ink ejected from said ejecting means and deposited on the recording medium, said ejecting means and said ultraviolet light irradiation means being integrally formed, said ultraviolet light irradiation means being arranged only at a location that is downstream of said ejecting means as said ejecting means and said ultraviolet light irradiation means move integrally in a scanning direction and upstream of said ejecting means as said ejecting means and said ultraviolet light irradiation means move integrally in a return path direction that is opposite to the scanning direction; and light quantity changing means for changing a light quantity of the ultraviolet light emitted from said ultraviolet light irradiation means to the ultraviolet curable ink, wherein said light quantity changing means controls said ultraviolet light irradiation means to emit ultraviolet light of a first light quantity for temporarily curing the ultraviolet curable ink as said ejecting means and said ultraviolet light irradiation means move integrally in the scanning direction, and, after that, controls said ultraviolet light irradiation means to emit ultraviolet light of a second light quantity for finally curing the ultraviolet curable ink as said ejecting means and said ultraviolet light irradiation means move integrally in the return path direction.

2. The inkjet printer as claimed in claim 1, wherein said light quantity changing means changes the light quantity of ultraviolet light emitted to the ultraviolet curable ink by changing the light intensity of ultraviolet light emitted from said ultraviolet light irradiation means.

3. The inkjet printer as claimed in claim 1, wherein said light quantity changing means changes the light quantity of ultraviolet light emitted to the ultraviolet curable ink by changing a moving speed of said ultraviolet light irradiation means.

4. The inkjet printer as claimed in claim 1, wherein said light quantity changing means controls said ultraviolet light irradiation means to only emit ultraviolet light of the first light quantity as said ejecting means and said ultraviolet light irradiation means move integrally in the scanning direction, and wherein said light quantity changing means controls said ultraviolet light irradiation means to only emit ultraviolet light of the second light quantity as said ejecting means and said ultraviolet light irradiation means move integrally in the return path direction.

5. A printing method for printing with ultraviolet curable ink, said printing method comprising:

an ejecting step for ejecting ultraviolet curable ink from an ejecting device to a recording medium;

a first ultraviolet light irradiation step for setting a light quantity of ultraviolet light emitted from an ultraviolet light irradiation device to a first light quantity for temporarily curing the ultraviolet curable ink and irradiating the ultraviolet curable ink ejected at said ejecting step and deposited on the recording medium with the ultraviolet light, the first ultraviolet light irradiation step being performed as the ejecting device and the ultraviolet light irradiation device move integrally in a scanning direction; and a second ultraviolet light irradiation step for setting the light quantity of ultraviolet light emitted from said ultraviolet light irradiation device to a second light quantity for finally curing the ultraviolet curable ink after said first ultraviolet light irradiation step and irradiating the ultraviolet curable ink temporarily cured at said first ultraviolet light irradiation step with the ultraviolet light, the second ultraviolet light irradiation step being performed as the ejecting device and the ultraviolet light irradiation device move integrally in a return path direction that is opposite to the scanning direction, wherein the ultraviolet light irradiation device is arranged only at a location that is downstream of the ejecting device as the ejecting device and the ultraviolet light irradiation device move integrally in the scanning direction and upstream of the ejecting device as the ejecting device and the ultraviolet light irradiation device move integrally in the return path direction.

6. The printing method as claimed in claim 5, wherein the light quantity of ultraviolet light emitted from the ultraviolet light irradiation device is set by setting the light intensity of ultraviolet light emitted from the ultraviolet light irradiation device.

7. The printing method as claimed in claim 5, wherein a moving speed of the ultraviolet light irradiation device during said first ultraviolet light irradiation step is different than the moving speed of the ultraviolet light irradiation device during said second ultraviolet light irradiation step.

8. The printing method as claimed in claim 5, wherein the ultraviolet light irradiation device only emits ultraviolet light of the first light quantity as said ejecting device and said ultraviolet light irradiation device move integrally in the scanning direction, and wherein the ultraviolet light irradiation device only emits ultraviolet light of the second light quantity as said ejecting device and said ultraviolet light irradiation device move integrally in the return path direction.

9. An inkjet printer to eject ultraviolet curable ink, said inkjet printer comprising:

an ejecting device configured to eject ultraviolet curable ink to a recording medium;

an ultraviolet light irradiation device configured to emit ultraviolet light to the ultraviolet curable ink ejected from said ejecting device and deposited on the recording medium, said ejecting device and said ultraviolet light irradiation device being integrally formed, said ultraviolet light irradiation device being arranged only at a location that is downstream of said ejecting device as said ejecting device and said ultraviolet light irradiation device move integrally in a scanning direction and upstream of said ejecting device as said ejecting device and said ultraviolet light irradiation device move integrally in a return path direction that is opposite to the scanning direction; and a light quantity changing device configured to change a light quantity of the ultraviolet light emitted from said ultraviolet light irradiation device to the ultraviolet curable ink, wherein said light quantity changing device is configured to control said ultraviolet light irradiation device to emit ultraviolet light of a first light quantity for temporarily curing the ultraviolet curable ink as said ejecting device and said ultraviolet light irradiation device move integrally in the scanning direction, and, after that, to control said ultraviolet light irradiation device to emit ultraviolet light of a second light quantity for finally curing the ultraviolet curable ink as said ejecting device and said ultraviolet light irradiation device move integrally in the return path direction.

10. The inkjet printer as claimed in claim 9, wherein said light quantity changing device is configured to change the light quantity of ultraviolet light emitted to the ultraviolet curable ink by changing the light intensity of ultraviolet light emitted from said ultraviolet light irradiation device.

11. The inkjet printer as claimed in claim 9, wherein said light quantity changing device is configured to change the light quantity of ultraviolet light emitted to the ultraviolet curable ink by changing a moving speed of said ultraviolet light irradiation device.

12. The inkjet printer as claimed in claim 9, wherein said light quantity changing device is configured to control said ultraviolet light irradiation device to only emit ultraviolet light of the first light quantity as said ejecting device and said ultraviolet light irradiation device move integrally in the scanning direction, and wherein said light quantity changing device is configured to control said ultraviolet light irradiation device to only emit ultraviolet light of the second light quantity as said ejecting device and said ultraviolet light irradiation device move integrally in the return path direction.

13. A printing method for printing with ultraviolet curable ink, said printing method comprising:

ejecting ultraviolet curable ink from an ejecting device to a recording medium;

emitting ultraviolet light from an ultraviolet light irradiation device set to a first light quantity for temporarily curing the ultraviolet curable ink as the ejecting device and the ultraviolet light irradiation device integrally move in a scanning direction; and emitting ultraviolet light from the ultraviolet light irradiation device set to a second light quantity for finally curing the ultraviolet curable ink as the ejecting device and the ultraviolet light irradiation device integrally move in a return path direction that is opposite to the scanning direction, wherein the ultraviolet light irradiation device is arranged only at a location that is downstream of the ejecting device as the ejecting device and the ultraviolet light irradiation device move integrally in the scanning direction and upstream of the ejecting device as the ejecting device and the ultraviolet light irradiation device move integrally in the return path direction.

14. The printing method as claimed in claim 13, wherein the light quantity of ultraviolet light emitted from the ultraviolet light irradiation device is set by setting the light intensity of ultraviolet light emitted from the ultraviolet light irradiation device.

15. The printing method as claimed in claim 13, wherein a moving speed of the ultraviolet light irradiation device during said first ultraviolet light irradiation step is different than the moving speed of the ultraviolet light irradiation device during said second ultraviolet light irradiation step.

16. The printing method as claimed in claim 13, wherein the ultraviolet light irradiation device only emits ultraviolet light of the first light quantity as said ejecting device and said ultraviolet light irradiation device move integrally in the scanning direction, and wherein the ultraviolet light irradiation device only emits ultraviolet light of the second light quantity as said ejecting device and said ultraviolet light irradiation device move integrally in the return path direction.

* * * * *